US006759986B1

(12) United States Patent
Saliga et al.

(10) Patent No.: US 6,759,986 B1
(45) Date of Patent: Jul. 6, 2004

(54) STACKED PATCH ANTENNA

(75) Inventors: Stephen V. Saliga, Akron, OH (US); Fred J. Anderson, Lakeville, OH (US); Daniel N. Johnson, Canton, OH (US)

(73) Assignee: Cisco Technologies, Inc., San Jose, CA (US)

( * ) Notice: Subject to any disclaimer, the term of this patent is extended or adjusted under 35 U.S.C. 154(b) by 0 days.

(21) Appl. No.: 10/146,609

(22) Filed: May 15, 2002

(51) Int. Cl.[7] ..... H01Q 1/38

(52) U.S. Cl. ..... 343/700 MS; 343/702; 343/872

(58) Field of Search ..... 343/700 MS, 702, 343/815, 818, 872

(56) References Cited

U.S. PATENT DOCUMENTS 5,382,959 A * 1/1995 Pett et al. ..... 343/700 MS
5,539,414 A * 7/1996 Keen ..... 343/700 MS
5,541,616 A * 7/1996 Kawahata et al. ..... 343/873
5,661,494 A * 8/1997 Bondyopadhyay ... 343/700 MS
5,798,734 A * 8/1998 Ohtsuka et al. ..... 343/700 MS
5,821,902 A * 10/1998 Keen ..... 343/700 MS
5,874,919 A * 2/1999 Rawnick et al. ..... 343/700 MS
6,278,413 B1 * 8/2001 Hugh et al. ..... 343/818

* cited by examiner

*Primary Examiner*—Tan Ho
(74) *Attorney, Agent, or Firm*—Tucker Ellis & West LLP

(57) ABSTRACT

A stacked patch antenna is disclosed which includes a first antenna element and a second antenna element for cooperating with the first antenna element. These antenna elements are preferably a passive parasitic element in combination with a driven element. A flexible substrate is provided having first and second opposing surfaces, each respectively in contact with the first and second antenna elements. The flexible substrate preferably has a desired dielectric property to provide a desired capacitance between the antenna elements. One or both of the antenna elements are formed on the respective opposing surface. The antenna element is preferably formed by printing.

16 Claims, 1 Drawing Sheet

STACKED PATCH ANTENNA

BACKGROUND OF THE INVENTION

The present invention is directed to the field of antennas, particularly patch antennas of the type used for wireless telecommunications devices. A simple patch antenna has a very small VSWR bandwidth, 0.7%–1.5% (where VSWR indicates "Voltage Standing Wave Ratio"). In order to increase the VSWR bandwidth of a patch antenna, a parasitic patch element can be deployed above a driven patch element. This is called a "stacked patch" antenna. The parasitic element increases the capacitance of the driven antenna element, thereby increasing the bandwidth of the antenna system. The separation between the driven element and the parasitic element contributes to the VSWR bandwidth and the antenna gain.

In a common stacked antenna arrangement, a parasitic element is etched onto a rigid circuit board using standard techniques for manufacturing printed circuit boards. The parasitic element is then typically mounted above a driven antenna element, which is also typically etched onto a rigid circuit board using standard techniques for manufacturing printed circuit boards. This type of construction can be expensive since several manufacturing steps are required to produce the parasitic element in the proper relation to the driven element. Also, the placement and separation between the elements is critical in realizing the desired bandwidth results. This can be hard to control using previous-type techniques, thereby adding to the cost of manufacture.

SUMMARY OF THE INVENTION

The difficulties and drawbacks of previous-type deployments are overcome by the method and apparatus of the present invention. The present stacked patch antenna includes a first antenna element and a second antenna element for cooperating with the first antenna element. These antenna elements are preferably a passive parasitic element in combination with a driven element. A flexible substrate is provided having first and second opposing surfaces, each respectively in contact with the second (parasitic) antenna element. The flexible substrate preferably has a desired dielectric property to provide the desired coupling between the antenna elements. One or both of the antenna elements are formed on the respective opposing surface. The antenna element is preferably formed by printing.

As will be realized, the invention is capable of other and different embodiments and its several details are capable of modifications in various respects, all without departing from the invention. Accordingly, the drawing and description are to be regarded as illustrative and not restrictive.

DETAILED DESCRIPTION OF THE INVENTION

Figure 1:
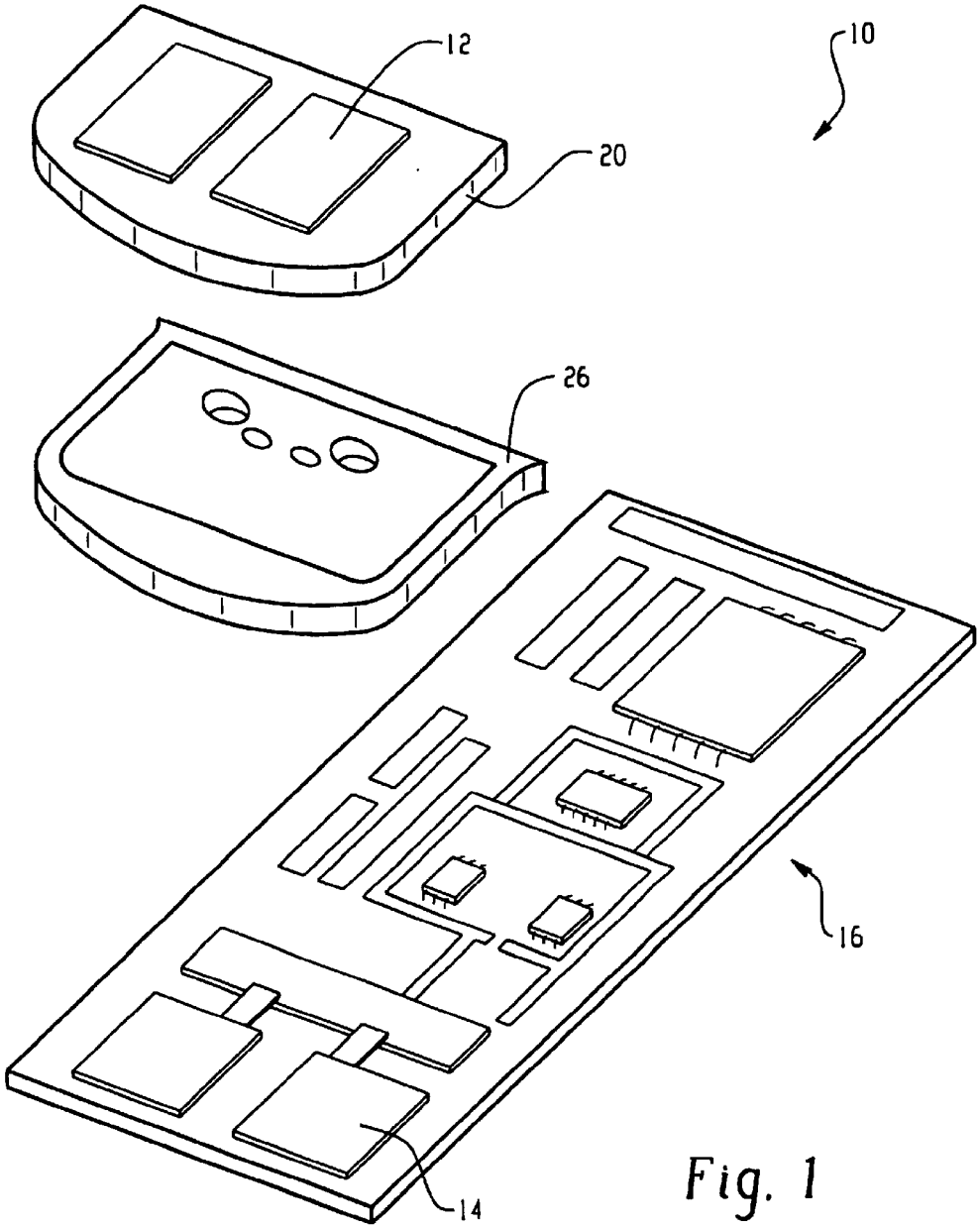
FIG. 1 is an exploded view showing the present antenna assembly included in a wireless radio device.
Figure 2:
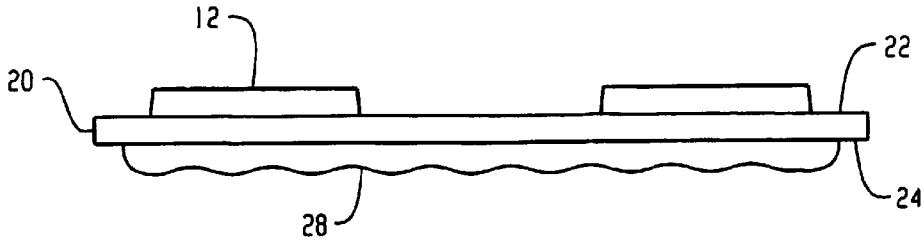
FIG. 2 is a side sectional view showing the layers of the parasitic antenna used with the present invention.

An exemplary embodiment of the invention is disclosed in the figures, where like reference numerals are understood to refer to like elements. As shown in FIGS. 1 and 2, a stacked patch antenna 10 is disclosed having a first antenna element and a second antenna element for cooperating with the first antenna element. In the preferred embodiment, the first antenna element is a passive antenna element 12, e.g., a parasitic patch element and the second antenna element is a driven antenna element 14 in connection with a ratio circuit 16, preferably a circuit of the type used to communicate over a Wireless Local Area Network (WLAN) in the 2.4 GHz or 5 GHz wireless bands in accordance with the IEEE 802.11 protocols. The driven element 14 can be formed on a printed circuit board using standard PCB etching techniques, preferably the same board as the radio circuit 16. Of course, it is appreciated that the invention is not limited to the particular wireless implementation and could be easily adapted without departing from the invention. As shown, one ore more pairs of antenna elements 12, 14 can be deployed without departing from the invention.

A flexible substrate 20 is provided having first and second opposing surfaces 22, 24. Passive antenna elements 12, can be formed on a respective opposing surface 22, 24. In the illustrated embodiment, the passive antenna element 12 is formed on the first opposing surface 22. The second opposing surface 24 is affixed in a spaced relationship to the driven antenna element 14. In the preferred embodiment, an intermediate mounting member can be provided, to which the second opposing surface is affixed, for defining the spaced relationship between the antenna elements 12, 14. The intermediate mounting member is preferably a radome 26, a plastic housing portion for enclosing the driven antenna element 14. It may also be contemplated that the intermediate mounting member may be formed integrally with the flexible substrate 20, of sufficient thickness to provide the necessary spaced relationship. In any case, the intermediate mounting member has predetermined dielectric properties so as to provide a predetermined capacitance between the antenna elements. This configuration thereby allows a VSWR bandwidth of at least 5%, thereby providing a significant improvement in wireless transmission and reception efficiency.

In the preferred embodiment, the second opposing surface 24 of the flexible substrate 20 includes an adhesive 28 for affixing the driven antenna element 14. The flexible substrate 20 is preferably formed of polycarbonate, such as the product sold under the name "Lexan" by General Electric Company of Schenectady, N.Y. Preferably, the parasitic element 12 can be formed of highly conductive polymer thick film such as Dupont Silver Carbon 5524. Preferably, the passive antenna 12 is printed onto a Lexan "sticker" or "decal" using standard printing techniques, e.g., silk screening, etc. The "sticker" is then affixed in the proper position at the required spacing above the driven elements. The decal can include decorative or descriptive indicia printed over the top surface of the antenna element 12. This provides protection for the antenna element and provides a location for the placement of a logo, etc.

The present method and apparatus provides considerable reduction in manufacturing and material usage over previous-type implementations, resulting in considerable reduction in production expense. Also, the use of a printed conductive thick film allows extremely close control over the physical dimensions of the parasitic element. Finally, the use of the "decal" allows for accurate positioning of the parasitic antenna elements in all directions. The present invention can be deployed in radio circuits 16 used in client devices and also in stationary network access point devices.

As described hereinabove, the present invention solves many problems associated with previous type devices. However, it will be appreciated that various changes in the details, materials and arrangements of parts which have been herein described and illustrated in order to explain the nature of the invention may be made by those skilled in the area within the principle and scope of the invention will be expressed in the appended claims.

We claim:

1. A stacked patch antenna comprising:

a passive antenna element;

a driven antenna element formed on a printed circuit board in connection with a radio circuit for cooperating with the passive antenna element;

a flexible substrate having first and second opposing surfaces wherein the passive antenna element is formed on the first opposing surface and wherein the second opposing surface comprises an adhesive for affixing in a spaced relationship to the driven antenna element.

2. The stacked patch antenna of claim 1 further comprising an intermediate mounting member, to which the second opposing surface is affixed, for defining the spaced relationship between the passive and driven antenna elements, wherein the intermediate mounting member has predetermined dielectric properties so as to provide a predetermined capacitance between the passive and driven antenna elements.

3. The stacked patch antenna of claim 1 wherein the flexible substrate is formed of polycarbonate.

4. The stacked patch antenna of claim 1 wherein at least one of the passive and driven antenna elements is formed of a conductive polymer.

5. A method of forming a stacked patch antenna comprising:

forming a driven antenna element onto a printed circuit board connected to a radio circuit;

providing a flexible substrate having first and second opposing surfaces for defining a predetermined separation;

forming a passive antenna element to the first opposing surface;

adhering a driven antenna element in a spaced relationship to the second opposing surface with an adhesive.

6. The method of claim 5 wherein the step of affixing comprises affixing to an intermediate mounting member, for defining the spaced relationship between the passive and driven antenna elements, wherein the intermediate mounting member is selected to have predetermined dielectric properties so as to provide a predetermined capacitance between the passive and driven antenna elements.

7. The method of claim 5 wherein the step of providing the flexible substrate comprises forming the flexible substrate of polycarbonate.

8. The method of claim 5 wherein the step of forming comprises printing the passive antenna element onto the first opposing side.

9. The method of claim 5 wherein at least one of the passive and driven antenna elements is formed of a conductive polymer.

10. A wireless telecommunications device comprising:

a radio circuit, formed on a printed circuit board, for generating and receiving radio signals;

a stacked patch antenna, in communication with the radio circuit, the stacked patch antenna further comprising:

a passive antenna element;

a driven antenna element, formed on the printed circuit board in connection with a radio circuit, for cooperating with the passive antenna element;

a flexible substrate having first and second opposing surfaces wherein the passive antenna element is formed on the first opposing surface and wherein the second opposing surface is affixed in a spaced relationship to the driven antenna element.

11. The wireless telecommunications device of claim 10 wherein the second opposing surface comprises an adhesive for affixing the driven antenna element.

12. The wireless telecommunications device of claim 10 further comprising an intermediate mounting member, to which the second opposing surface is affixed, for defining the spaced relationship between the passive and driven antenna elements, wherein the intermediate mounting member has predetermined dielectric properties so as to provide a predetermined capacitance between the passive and driven antenna elements.

13. The wireless telecommunications device of claim 10 wherein the flexible substrate is formed of polycarbonate.

14. The wireless telecommunications device of claim 10 wherein at least one of the passive and driven antenna elements is formed of a conductive polymer.

15. The wireless telecommunications device of claim 10 wherein the wireless telecommunications device is one of a mobile client device and a wireless access point.

16. The wireless telecommunications device of claim 10 wherein the radio circuit generates and receives radio signals in accordance with IEEE 802.11 protocols.

* * * * *

UNITED STATES PATENT AND TRADEMARK OFFICE

CERTIFICATE OF CORRECTION

PATENT NO. : 6,759,986 B1
DATED : July 6, 2004
INVENTOR(S) : Saliga et al.

It is certified that error appears in the above-identified patent and that said Letters Patent is hereby corrected as shown below:

Title page,
Item [73], Assignee, the name of the assignee should be -- Cisco Technology, Inc. --

Signed and Sealed this

Twenty-fourth Day of August, 2004

JON W. DUDAS
*Director of the United States Patent and Trademark Office*